United States Patent [19]

Serex et al.

[11] 4,008,998

[45] Feb. 22, 1977

[54] TRANSFERS DYEING BY ROLLING UP WEBS WITH A CONDUCTOR

[75] Inventors: Charles Serex, Geneva, Switzerland; Bernard Hugelin, Gaillard; Robert Decombe, Ferney-Voltaire, both of France

[73] Assignee: Sublistatic Holding S.A., Glaris, Switzerland

[22] Filed: May 9, 1974

[21] Appl. No.: 468,588

[30] Foreign Application Priority Data

May 11, 1973 Switzerland ..... 6691/73

[52] U.S. Cl. ..... 8/2.5 A; 8/149.3; 34/1; 34/26; 34/40; 101/426; 101/470; 432/202

[51] Int. Cl.[2] ..... D06P 7/00; B41C 1/06

[58] Field of Search ..... 101/470, 471, 426; 8/2.5 A, 149.3; 34/1, 26, 40; 96/27; 432/202

[56] References Cited

UNITED STATES PATENTS

| | | | |
|---|---|---|---|
| 1,941,362 | 12/1933 | Newcomb | 34/1 X |
| 3,245,796 | 4/1966 | Burg | 8/2.5 |
| 3,372,487 | 3/1968 | Eisler | 34/1 |
| 3,396,415 | 8/1968 | Meier | 8/149.3 |
| 3,455,687 | 7/1969 | Holstead et al. | 96/27 |
| 3,490,371 | 1/1970 | Games | 101/426 |
| 3,508,492 | 4/1970 | Seibert et al. | 101/470 |
| 3,620,881 | 11/1971 | Kanmeglesser et al. | 101/471 |
| 3,632,291 | 1/1972 | Defago et al. | 8/2.5 |

FOREIGN PATENTS OR APPLICATIONS

| | | | |
|---|---|---|---|
| 136,917 | 4/1950 | Australia | 34/1 |
| 859,049 | 12/1952 | Germany | 34/1 |
| 263,306 | 3/1929 | Italy | 34/1 |
| 1,211,149 | 11/1970 | United Kingdom | 8/2.5 |

OTHER PUBLICATIONS

Textile World, Feb. 1972, p. 50, Transfer Printing: . . .

*Primary Examiner*—Clyde I. Coughenour
*Attorney, Agent, or Firm*—Wenderoth, Lind & Ponack

[57] ABSTRACT

Dry transfer printings are obtained by bringing the printed surface of a temporary carrier sheet into face-to-face contact with the surface of a substrate sheet to be printed, forming the joined sheets into a coil and heating the coil to a temperature and for a time period sufficient to cause transfer of transferable dyestuff from the printed surface of the temporary carrier to the surface of the substrate to be printed.

17 Claims, 3 Drawing Figures

TRANSFERS DYEING BY ROLLING UP WEBS WITH A CONDUCTOR

The present invention relates to a dyeing and printing process as well as to a device for carrying it out.

It is already known to dye or print flat surfaces by transferring dyestuffs in the vapour phase from a temporary carrier onto the substrate to be treated. The combination consisting of the carrier and the substrate pressed against one another is heated (above 160° C, for example between 160° and 220° C at atmospheric pressure) for a sufficiently long time to allow the dyestuff or dyestuffs present on the carrier to vaporise or sublime and to penetrate into the substrate (for example, between 15 to 40 seconds and one to two minutes). It is also known to apply vaporisable substances other than dyestuffs, for example optical blueing agents or other finishing agents, by the same process.

A distinction can be made amongst the following apparatuses which are usually employed in dry transfer by the application of heat:

1. The heated flat press in which a certain surface area of the material to be treated is brought into contact discontinuously with the temporary carrier. The transfer is carried out at normal pressure or in vacuo.

2. The calender on which the substrate to be treated and the temporary carrier are continuously pressed simultaneously against a heating element, for example by means of an endless belt.

3. The calender equipped with a permeable pressure surface connected to an apparatus which generates a vacuum, or, on the other hand, an excess pressure, which makes it possible to keep the temporary carrier in contact with the substrate to be treated by means of suction or pressure; the excess pressure created at the level of the surface area of contact makes it possible for the vapours formed by heating to be sucked through the substrate; heating is effected by means of a source of radiant heat (for example, infra-red radiation or micro-waves) and is preferably applied to the reverse side of the temporary carrier.

The devices mentioned above do not make it possible to exceed production rates of 1 to 30 meters per minute. Moreover, since the duration of contact between the substrate and the temporary carrier must be as short as possible in order to maintain an acceptable production rate, these devices make it necessary to use high transfer temperatures, which are rather undesirable for some of the textiles treated. Furthermore, they possess the disadvantage of changing the handle and the appearance of the treated article by flattening its surface, by causing unattractive shiny effects to appear, and the like. Finally, in the case of some substrates, they do not make it possible to achieve satisfactory penetration. The aim of the present invention is to correct these disadvantages.

It consists of carrying out the transfer while the material to be treated and the temporary carrier are in the form of a coil, that is to say after several hundreds and even thousands of linear meters of the material to be treated (substrate) and of the temporary carrier have been wound up on top of one another. Thus, it is possible, according to the present process, to produce a coil consisting of the temporary carrier, the substrate to be treated and a heating belt; it is also possible to heat, inside a leakproof chamber preferably, a coil consisting of the carrier and the substrate to be treated, optionally together with a non-heating belt which is a good conductor of heat and is preferably impermeable to the dyestuffs.

The aspect of the invention wherein the temporary carrier and the substrate are wound up on top of one another is illustrated in the figures of the drawing, FIG. 1, FIG. 2 and FIG. 3, presented.

Figure 1:
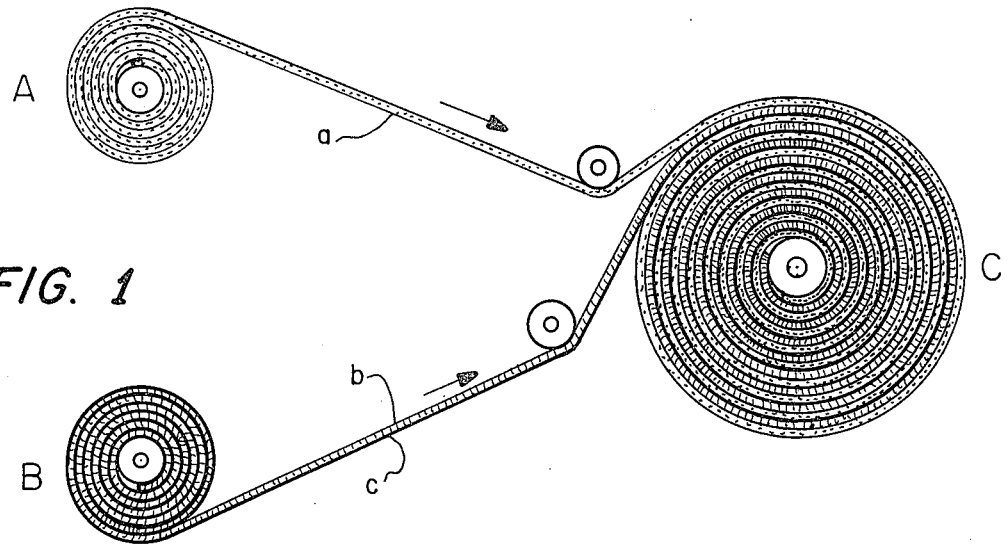
FIG. 1 is a schematic diagram of the rolling of the substrate and temporary carrier into a coil.
Figure 2:
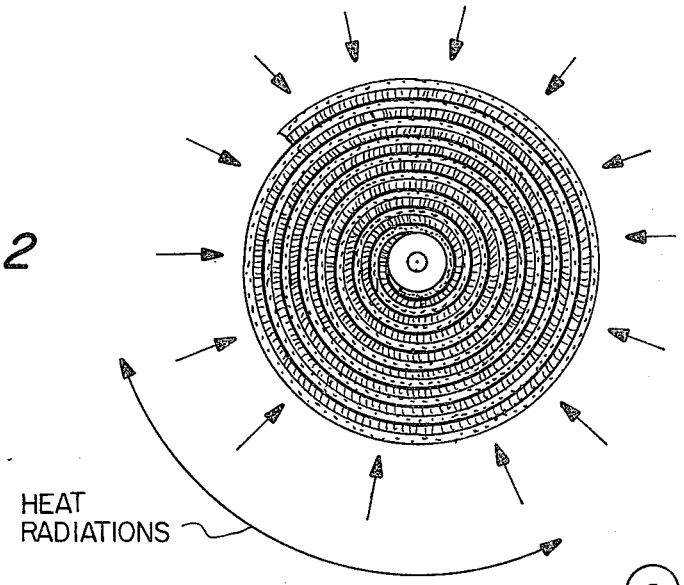
FIG. 2 is a schematic diagram of the coil consisting of the temporary carrier and the substrate.
Figure 3:
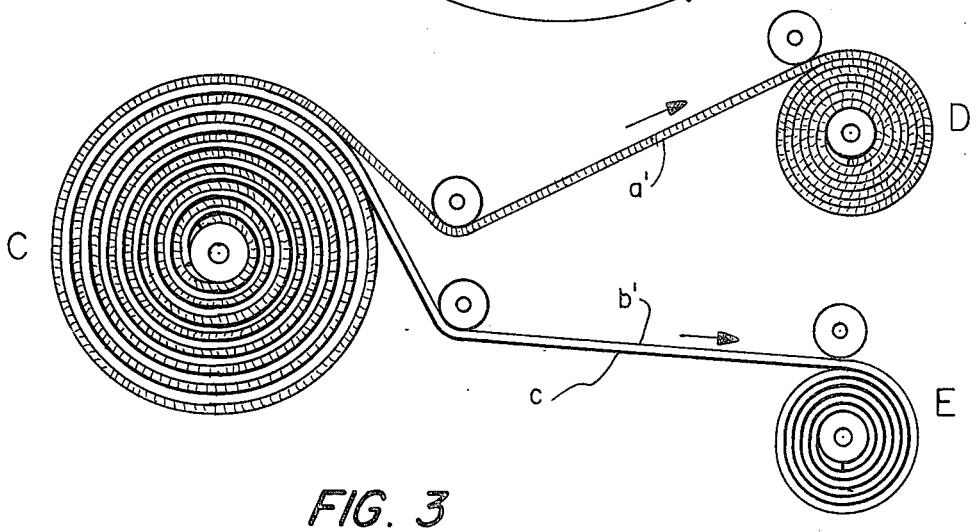
FIG. 3 is a schematic diagram illustrating the separating of the treated substrate and the used transfer sheet.

Referring to FIG. 1, A is the coiled substrate to be printed. B is the coiled transfer sheet (temporary carrier). *a* is the substrate to be printed. *b* is the print containing the heat transferring dyestuff. *c* is the base of the transfer sheet. With reference to FIG. 3, D is the coiled, printed substrate. E is the coiled, used transfer sheet. *a'* is the substrate printed with the transfer dyestuffs. *b'* is the print from which the dyestuffs have transferred.

According to a first variant of the process, the temporary carrier, the substrate to be treated and a heating belt are wound up on top of one another in any order whatsoever. The heating belt can be, for example, an electrically heated belt or a pre-heated metal strip.

The temporary carrier is preferably wound up between the heating belt and the substrate.

According to a second variant, (*a*) the temporary carrier, (*b*) the substrate to be treated and optionally (*c*) a belt which is a good conductor of heat is preferably impermeable to the dyestuff vapours are also wound up on top of one another. The heat-conducting belt will be placed between the reverse side of the temporary carrier and the reverse side of the substrate to be treated, so as to prevent the latter from being stained by dyestuffs passing through the temporary carrier.

In order to double the production rate for a given length of heating belt, it is possible to wind up the combination of temporary carrier and substrate on both sides of the heating belt, the latter being in contact with the reverse side of the temporary carrier, that is to say with the face of the latter which does not carry any transferable substance.

The same type of coil can also be produced by folding the carrier/substrate combination in two (parallel to the edge) on either side of the heating belt, and this makes it possible to treat a width, the size of which is double that provided by the apparatus.

It is also possible to treat both faces of a substrate, and particularly to produce a "reversible" effect, by means of matching prints on the reverse side and the right side of the substrate, and to do so without having to effect difficult registering. It suffices to fold in two the temporary carrier possessing a pattern to be transferred which is symmetrical relative to the fold, to place the substrate to be treated inside the fold, and to wind up this "sandwich" and a heating belt, or only a belt which conducts heat, on top of one another.

The heating belt can consist of a combination of electro-resistant filaments or tapes or of a single flat and flexible electrical resistance; the electro-resistant material is surrounded by a heat-resistant material which possesses electro-insulating properties, such as asbestos or a synthetic polyamide or polyimide, in fibre or lacquer form, such as HT-4 fibres of Messrs Du Pont of Nemours, and particularly aromatic polyamides, for example of the Nomex type, also of Messrs Du Pont de Nemours. Resins produced from a mixture of maleimide, an epoxy compound and an acid anhydride, or some polyethers and linear aromatic thioethers or poly-(amide-imide)s should also be mentioned.

Of course, any other material whatsoever which possesses heat stability and similar or better electro-insulating properties can be used as the insulator.

This insulator can be applied in the form of strips, tapes or sheets produced from films, woven frabrics or non-woven fabrics, for example of the "NOMEX paper" type, sandwiching the electro-insulating core. The latter can consist of a combination of filaments or tapes. Several "sandwiches" can be superposed. The insulator can also be wound around each resistant filament or tape, being in the form of a yarn or tape made, for example, from long or short Nomex fibres.

The resistances thus insulated can be woven or knitted on a warp loom or a circular loom; they can be positioned in the direction of the weft or in that of the warp, and even in both directions simultaneously.

These electrical resistances can also be placed on non-woven strips or tapes or on surfaces formed in accordance with the so-called "MALINO" or "ARACHNE" technique, the combination of these resistances being simultaneously held and protected by a coil of insulating yarns, or, as already explained, between two papers of the "NOMEX" type. Both external faces of the heating belt can be covered, by lamination, with sheets of aluminum foil, and this makes it possible, if necessary, to achieve minimum temperature variations between the electrical resistances at the surface of the heated belt.

A flexible belt can also be used, which is resitant to folding and is stable at high temperatures (such as a nylon, teflon or glass film or woven fabric), which is covered with a thin layer of material which conducts electricity (carbon black or graphite, optionally grafted with silicone-type and vinyl monomers) and to which electrodes (such as copper wires covered with tin, sewn for example on the edges of this belt with fine wires which conduct electricity) are attached, the whole being preferably covered with an insulating material (elastomer or flexible synthetic resin).

The belt, which is impermeable to dyestuffs and which conducts heat, can consist of a film or of a metallic or metallised non-woven or woven fabric, for example aluminium foil.

The substrates to be treated, the temporary carriers and the heating belt can be wound up on an auxiliary installation similar to the installations for winding up under constant tension which are available commercially and are used for winding up strips of textiles uniformly.

It is desirable to pre-heat the heating belt electrically to a temperature close to that at which the dyestuff or transferable substance vaporises to a substantial extent, of course taking into account the temperature which the substrate to be treated can withstand.

Instead of pre-heating the heating belt, it is also possible to pre-heat the substrate to be treated, optionally to a temperature below the sublimation or volatilisation temperature of the materials to be transferred, before forming the coil and heating to the vaporisation or sublimation temperature. This operation can be carried out by passing the substrate over or between heated rollers.

The pre-heating can be carried out already before or during the winding-up process, or between the winding-up process and while the rolls are conveyed into a closed chamber.

In the case where the heating is not effected by the heating belt but only by means of a heated chamber, it is also advantageous to carry out a pre-heating.

One of the effects of this pre-heating is to expand and to remove to the greatest possible extent the air imprisoned by the substrate to be treated, and this is of very particular value when the process is carried out under reduced pressure.

After the winding-up process, in the case where they contain a heating belt, the rolls which may or may not have been pre-heated can either be raised to the desired transfer temperature or be conveyed into a hermetically sealed chamber wherein a higher or lower partial vacuum will permit uniform vaporisation of the substance to be transferred. If, by pre-heating, the rolls have been raised to a temperature close to that necessary for transfer to take place at atmospheric pressure, the heating carried out in the vacuum chamber is optional, since the vaporisation or sublimation point of the transferable substances is lowered as a lower pressure is produced.

Inside this same chamber, it is possible to replace the vacuum by an excess pressure and thus to carry out the vaporisation at a pressure above atmospheric pressure.

The duration of the treatment inside the chamber can vary and depends on the effects desired.

The heating belt connected to the main electricity supply can remain at the constant pre-heating temperature; if so desired, it is possible gradually to raise the said temperature until the desired transfer effect is produced, in such a way that a transfer temperature which is optimum with respect to the transfer yield and to retaining the properties of the substrate to be treated, is brought to this optimum point under the pressure or vacuum conditions prevailing inside the hermetic chamber.

The closed chamber which can be used in the invention can be equipped with an installation which makes it possible to create a higher or lower partial vacuum therein, or on the other hand to create an excess pressure therein. It can optionally be a heated chamber.

The latter condition is necessary if the coils have been formed without a heating belt. The heating can be effected, for example, by injecting hot air. This chamber can also be provided with installations which make it possible to enrich the atmosphere with superheated steam or with the vapour from an organic solvent.

It is possible, for example, to use the leakproof chambers provided for effecting the fixing, under pressure and under hot conditions, of dyed textiles which have been pre-heated and wound up on a loading beam. What is generally involved is simply a sufficiently large cylindrical tank which is open at one end and comprises a closing element which makes it possible to close it effectively in a leakproof manner when subjected to pressure.

This chamber is preferably equipped at its lower part with rails which extend external rails guiding a carrier on which the substrate to be treated is wound up around a beam. These rails, which make it possible easily to move the carrier towards the inside of the chamber, can themselves be mounted on a carriage positioned so as to move on a track which is external to the chamber and which can be shifted transversely to this chamber. This makes it possible to put a carrier in the loading position while a previously loaded carrier is being treated inside the chamber.

A second beam can be mounted on the carrier which already carries the coil to be treated. In this case, once the carrier has been introduced into the leakproof chamber, this coil can then be unwound and rewound from one beam to the other.

In the case where a solvent vapour or steam is used, the chamber is preferably equipped with an auxiliary heater which makes it possible to reduce to the minimum the condensation inside the chamber and to remove the risk of droplets of water or solvent falling on the fabric.

It is possible to provide several heated chambers arranged in series, the coils passing from a pre-heating chamber to an actual heating chamber, and in cases where good penetration is necessary, to a post-heating chamber in which the coil would be kept for a long time at a relatively low temperature, which is, however, sufficiently high to improve the penetration throughout the thickness of the substrate of the volatile material transferred. This post-heating can be carried out at the same time as the substrate is separated from the rest of the coil and can be continued on the coil comprising only the substrate.

The flexible carriers which can be used in the present invention and which carry sublimable or vaporisable dyestuffs are manufactured in accordance with known processes, for example in accordance with the technique described in French Pat. Nos. 1,223,330 and 1,585,119 for multi-colour designs. They can also be manufactured by printing strips of paper by means of a rotary frame. The sublimable or vaporisable dyestuffs can belong to various categories; for example, disperse dyestuffs and vat dyestuffs or basic dyestuffs can equally well be used according to the invention. The dyestuffs described in the above French Patents and in French Pat. No. 2,076,149 and in the patents corresponding to Swiss Application Nos. 45/73 and 3,734/73 may be mentioned.

The actual transfer operation is carried out on the coil itself at a temperature below or equal to 220° C, for example from 160° to 220° C, and preferably at 185°–210° C, or, under reduced pressure, at less than 185° C. Heating is carried out for one or more minutes. Thus, according to the present process, it is possible to transfer volatile materials, generally dyestuffs, onto several hundreds of meters of woven fabric in a few minutes, whilst according to the conventional heat-printing processes, the rates of transfer scarcely exceed 1 to 30 meters/minute.

Since the present process allows heating for as long a time as is necessary (from a few tens of minutes to one hour) at the chosen temperature, whilst maintaining an acceptable rate of production, it makes it possible not only to increase the transfer printing or dyeing yield by the treatment of coils and the application of reduced pressure, by simply combining a heated chamber and an interlying belt made with a flexible material which is a good conductor of heat and is in addition impermeable to the dyestuff vapours; this method also makes it possible to carry out transfers by maintaining contact for a period of a few tens of minutes to one hour; the contact temperature and pressure can thus be lowered, which increases the quality of the handle, and it is possible to remain below the high temperatures at which diffusion of the dyestuff takes place. Better penetration of the printing is achieved without losing the sharpness of the transferred pattern. Moreover, since it is possible to maintain contact until the dyestuff on the temporary carrier has been exhausted, the effects due to a temperature gradient are thus eliminated. These advantages are valuable, particularly for the treatment of thick materials such as velvets or carpets, or for one-colour dyeings.

Once the transfer operation has been carried out, the combination is unwound, where appropriate after normal pressure has been set up inside the closed chamber and the wound-up goods have been removed, the temporary carrier is separated from the substrate and, where appropriate, the latter is separated from the heating, or only conducting, belt. This operation can be carried out in a heated chamber, and the substrate can be kept hot for a certain period, in order to improve the penetration of the transferred material throughout its thickness.

The invention will be better illustrated with the help of the following non-limiting examples. In these examples, the parts and percentages are expressed by weight and the temperatures are in degrees Celsius, unless otherwise indicated.

EXAMPLE 1

This involves printing 500 meters of a texturised polyester double jersey, of width 180 cm and of weight 240 g per linear meter, with a pattern No. 1 over 150 meters, a pattern No. 2 over 100 meters and a pattern No. 3 over 250 meters.

The patterns Nos. 1, 2 and 3 are printed on a temporary paper carrier by means of dyestuff preparations of the type of those mentioned in Swiss Patents 489,587 and 510,095. They are thereafter joined to one another by means of heat-resistant self-sticking strips, using a machine similar to that normally employed for inspecting or examining woven fabrics or wallpapers.

A continuous heating belt of length 255 meters and of width 2 meters is also used.

The combination formed by the printed paper carrier and the textile carrier is wound up on either side of the heating belt, the non-printed face of the paper being pressed against this heating belt whilst the printed face is in contact with the textile. A roll of length 250 meters is thus produced.

Winding-up is carried out at 170° C and 40 meters/minute: Once the roll has been wound up in a "sandwich", the latter is introduced into a closed chamber wherein a vacuum of, for example, 13 mm of mercury can be established very rapidly. The roll is then treated for 60 seconds under this vacuum and at this temperature of 170° C. If the closed chamber wherein the transfer is carried out is occupied for 3 minutes: 1 minute to produce the vacuum, 1 minute to complete the transfer and 1 minute to return to normal atmospheric pressure, the productivity of the said installation will be 500 meters every 3 minutes, that is to say more than 150 meters/minute, using a heating belt of length 250 meters.

The preparation of the layered rolls formed by the heating belt, the temporary carrier and the textile substrate is carried out independently of the chamber wherein the transfer takes place.

Inside the transfer chamber, it is possible to vary the transfer conditions whilst keeping the temperature constant, by varying the vacuum and the treatment time.

EXANPLE 2

A heating belt of length of 1,005 meters and of width 200 cm is used. The process involves transferring a single pattern onto 2,000 meters of knitted polyester fabric in the form of a Raschel knitted fabric, the yarns of which are 100% based on short polyester fibres; the linear weight of the knitted fabric is 160 grams per meter for a width of 180 cm.

Winding-up will be carried out in a manner similar to Example No. 1 but this time at a rate of 100 meters/minute, the heating belt being raised to a temperature of 150° C.

The temporary carrier is still printed with the same dyestuff preparations as those recommended in Example 1. Once the layered roll has been produced, it will be introduced into a closed chamber and the heating belt will be raised to 200° C. 40 seconds are sufficient to produce a satisfactory transfer, still at the same temperature of 200° C, at atmospheric pressure.

Taking into account an average period of time for completing the transfer, a productivity of 2,000 meters approximately every 3 minutes will thus be achieved, corresponding to approximately 700 meters/minute.

This productivity is that of the chamber wherein the transfer takes place. Of course, layered rolls prepared for the transfer must always be ready to be introduced into the transfer chamber and, once the transfer has been carried out, they must be ready to be unwound at high speed in order to be cooled.

EXAMPLE 3

The same heating belt is used as in Example 2, but this time the process involves transferring 4 temporary carriers, each of 500 meters.

As in Example 1, the 4 temporary carriers are glued end to end by means of heat-resistant self-sticking strips.

What is involved this time is transferring the patterns onto a textile substrate based on continuous 6,6 polyamide filaments in the form of a Raschel knitted fabric of width 160 cm, weighing 120 g per linear meter.

Winding-up is carried out on the same winding apparatus as in Examples 1 and 2, at a rate of 100 meters/minute. The heating belt has been pre-heated to 165° C. Once the layered roll is ready, it will be introduced into the closed chamber and, while a vacuum of approximately 10 mm of mercury is established, the heating belt is raised to 186° C at the rate of 7° C/minute. The treatment time is thus 3 minutes.

2,000 meters can thus be treated over the course of 4 minutes, if the additional minute necessary to return to normal pressure is taken into account.

In this case, the productivity of the chamber will thus be 500 meters/minute.

EXAMPLE 4

100 meters of a non-backed tufted carpet material, made of polyamide and of width 2.40 meters, are passed between two rollers heated to 210° C; thereafter they are wound up together with a strip of paper printed for transfer and an inset belt which is also preheated, at the rate of 60 meters per minute. This winding-up operation is carried out in a chamber heated to 180° C.

The temporary carrier consists of a strip of paper of the parchment type, which is grease-proof, non-layered and printed by means of a rotary frame or by photogravure. The very flexible inset belt which is resistant to folding is a belt of heat-resistant woven fabric, metallised on both faces by an aluminum deposit; it projects by 50 cm on either side of the coil.

Once the coil is complete, it is conveyed by a system of rails to a second chamber which is leakproof. A vacuum of 100 mm Hg is established inside this chamber over the course of two minutes, and air heated to 180° C is blown into it. The 100 meters of carpet are slowly unwound and rewound for 10 minutes, the end of the first coil being at the center of the second. The final coil is then exposed to 160° C for 30 minutes.

Good penetration of the printing throughout the carpet is achieved, without the latter turning yellow.

It should be noted that the leakproof chamber is occupied for only approximately 12 minutes by the coil to be treated.

EXAMPLE 5

A strip of woven polyester fabric of length 50 meters and width 1.80 m is freed from dust and then wound up together with a temporary carrier printed with a plain-coloured layer on a paper base of the parchment type, and an inset belt, the latter is the same type as that described in Example 4 and is wound up in contact with the non-printed face of the paper.

The coil is then introduced into a leakproof chamber heated to 200° C. The temperature recorded at the surface of contact between the substrate and the temporary carrier is 172° C.

After 10 minutes, the coil is subjected to a temperature of 160° C for 20 minutes.

A very even plain-coloured printing, which has penetrated the woven fabric to a certain thickness, is thus achieved. The handle is satisfactory.

We claim:

1. In a process for dry transfer dyeing or printing which comprises bringing the dry transfer dyestuff and/or optical brightening agent treated surface of a temporary carrier sheet into face-to-face contact with the surface of a substrate to be dyed or printed and heating the joined materials while in contact to a temperature of from 150° to 220° C. for a period of time sufficient to cause transfer of transferable material to the surface of the substrate to be dyed or printed and subsequently separating the temporary carrier from the substrate, the improvement according to which a conductive belt is provided said belt being placed in face-to-face contact with the nontreated surface of the temporary carrier, winding the temporary carrier, substrate to be dyed or printed and conductive belt into a coil, placing the coil in a heated environment and conducting heat into the coil by means of the conductive belt to cause transfer of transferable material to the surface of the substrate to be dyed or printed.

2. A process according to claim 1 wherein a heat conductive belt is placed into face-to-face contact with the non-treated surface of the temporary carrier and is wound into the coil with the temporary carrier and substrate.

3. A process according to claim 1 wherein the substrate is pre-heated before the coil is formed.

4. A process according to claim 1 wherein the formation of the coil and a pre-heating are carried out simultaneously.

5. A process according to claim 1 wherein the heat conductive belt is heated electrically and consists of an electro-resistant material surrounded by an electro-insulating material which is resistant to heat.

6. A process according to claim 5 wherein the electro-insulating material is an aromatic polyamide which is resistant to heat.

7. A process according to claim 5 characterized in that the electro-insulating material is applied in the form of a non-woven fabric.

8. A process according to claim 1 wherein the temporary carrier is positioned between the heat conductive belt and the substrate to be treated.

9. A process according to claim 1 wherein the heat conductive belt is positioned between two temporary carriers, in contact with the face of these carriers which does not carry the substance to be transferred, the other face of these carriers being in contact with the substrate to be treated.

10. A process according to claim 5 wherein the heated belt is pre-heated before transfer is effected to a temperature below the transfer temperature.

11. A process according to claim 1 wherein the coil is heated in a hermetic chamber.

12. A process according to claim 1 wherein the transfer is carried out under reduced pressure.

13. A process according to claim 1 wherein the temporary carrier is made of paper which has been dyed or printed with disperse dyestuffs or basic dyestuffs.

14. A process according to claim 13 wherein basic dyestuffs are transferred onto a substrate of acid modified synthetic fibres.

15. A process according to claim 14 wherein the substrate is polyacrylonitrile.

16. A process according to claim 13 wherein disperse dyestuffs are transferred onto polyethylene terephthalate.

17. A process according to claim 1 wherein disperse dyestuffs or acid dyestuffs are transferred onto synthetic polyamides.

* * * * *